US007755235B2

(12) United States Patent
Main

(10) Patent No.: US 7,755,235 B2
(45) Date of Patent: Jul. 13, 2010

(54) DOWNHOLE GENERATOR FOR DRILLSTRING INSTRUMENTS

(75) Inventor: Richard Brewster Main, Elk Grove, CA (US)

(73) Assignee: Stolar, Inc., Raton, NM (US)

( * ) Notice: Subject to any disclaimer, the term of this patent is extended or adjusted under 35 U.S.C. 154(b) by 361 days.

(21) Appl. No.: 12/053,598

(22) Filed: Mar. 22, 2008

(65) Prior Publication Data

US 2009/0236149 A1 Sep. 24, 2009

(51) Int. Cl.
*H02K 5/10* (2006.01)
*H02K 5/12* (2006.01)
*E21B 4/04* (2006.01)

(52) U.S. Cl. ..... 310/88; 175/104

(58) Field of Classification Search ..... 310/88, 310/87; 175/104
See application file for complete search history.

(56) References Cited

U.S. PATENT DOCUMENTS 6,257,355 B1 * 7/2001 Baker ..... 175/50
6,863,124 B2 * 3/2005 Araux et al. ..... 166/66.4
7,141,901 B2 * 11/2006 Spring ..... 310/77
7,481,283 B2 * 1/2009 McDonald et al. ..... 175/106
7,687,950 B2 * 3/2010 Kuckes ..... 310/87
2003/0132003 A1 * 7/2003 Arauz et al. ..... 166/370
2004/0035608 A1 * 2/2004 Meehan et al. ..... 175/40

* cited by examiner

*Primary Examiner*—Quyen Leung
*Assistant Examiner*—Leda Pham
(74) *Attorney, Agent, or Firm*—Richard B. Main

(57) ABSTRACT

A downhole generator comprises a turbine coaxially disposed inside a section of drillstring and that will be spun when hydraulic or pneumatic flows are pushed through to a drillbit motor on a distal end. The turbine, in turn, spins permanent magnets in an orbit around the outside of a cylindrical containment shell. Such containment shell is made of titanium or aluminum and will allow the spinning magnets fields to enter and induce electrical currents in coils within. Current from the coils is rectified and filtered to provide a DC operating voltage through intrinsically safe connectors to various loads including drillstring steering controls, radars, and telemetry circuits. The hydraulic and pneumatic flows stream past all around the cylindrical containment shell from the turbine on their way to the drillbit motor.

9 Claims, 3 Drawing Sheets

DOWNHOLE GENERATOR FOR DRILLSTRING INSTRUMENTS

BACKGROUND OF THE INVENTION

1. Field of the Invention

Figure 1A:
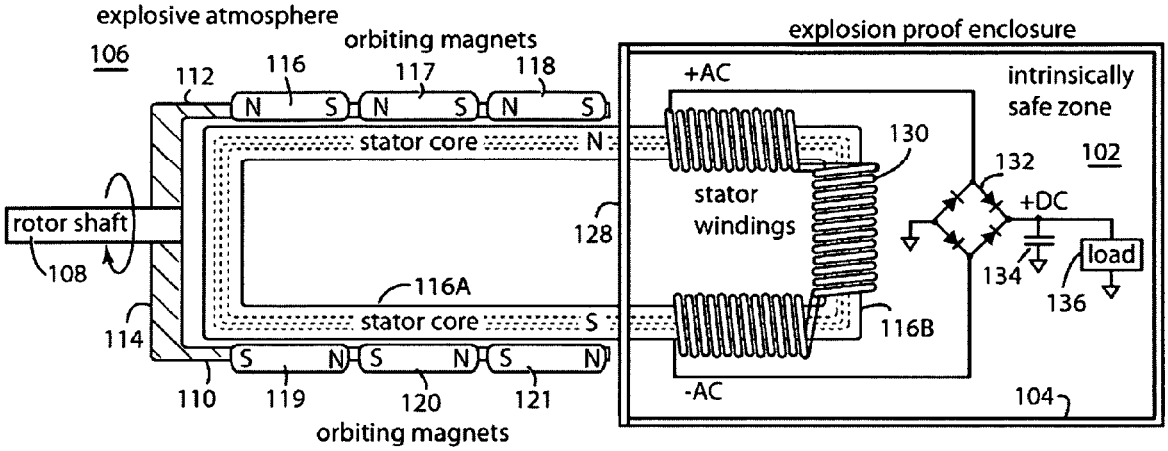

The invention relates generally to drilling and mining equipment, and more specifically to generators for electrically powering telemetry and radar instrumentation at the distal end of a drillstring using the flow of hydraulic fluids supplied to the drill bits.

2. Description of the Prior Art

Instrument packages placed at the ends of drillstrings can provide important information from radar scans to help guide direction drilling efforts. Both the radar and the telemetry used to communicate data and commands need a safe source of electrical power. Typical drillstrings can be miles long and under great pressure from the fluids and gases being pumped around and through them, and the depths of earth explored. Wiring power through the drillstrings and into explosive methane and coal deposits is not practical. So what is needed is an intrinsically safe power generator that can provide enough power in the severe environments encountered.

The production of coal and methane depends upon the environment of the original coal bed deposit, and any subsequent alterations. During burial of the peat-coal swamp, sedimentation formed the sealing mudstone/shale layer overlying the coal bed. In deltaic deposits, high-energy paleochannels meandered from the main river channel. Oftentimes, the channels scoured through the sealing layer and into the coal seam.

High porosity sandstone channels often fill with water. Under the paleochannel scour cut bank, water flows into the face and butt cleats of the coal bed. Subsequent alterations of the seam by differential compaction cause the dip, called a roll, to occur in the coal bed. Faults are pathways for water flow into the coal bed.

Drilling into the coal bed underlying a paleochannel and subsequent fracturing can enable significant flows of water to enter. The current state of the art in horizontal drilling uses gamma sensors in a measurements-while-drilling (MWD) navigation subsystem to determine when the drill approaches a sedimentary boundary rock. But if sandstone is protruding into the coal, such as results from ancient river bed cutting and filling, then the gamma sensor will not help. Sandstone does not have significant gamma emissions, so this type of detection is unreliable. Drilling within the seam cannot be maintained when the seam is not bounded by sealing rock.

Methane diffusion into a de-gas hole improves whenever the drillhole keeps to the vertical center of the coal seam. It also improves when the drillhole is near a dry paleochannel. Current horizontal drilling technology can be improved by geologic sensing and controlling of the drilling horizon in a coal seam.

There are a number of conventional ways directional drills use to steer in a desired direction. One involves placing the drill bit and its downhole motor at a slight offset angle from the main drillstring. The whole drillstring is then rotated to point the offset angle of the drill bit in the direction the operator wants the borehole to head. Another method involves an articulated joint or gimbal behind the drill bit and its downhole motor and using servo motors to angle the joint for the desired direction.

SUMMARY OF THE PRESENT INVENTION

Briefly, a downhole generator embodiment of the present invention comprises a turbine coaxially disposed inside a section of drillstring and that will be spun when hydraulic or pneumatic flows are pushed through to a drillbit motor on a distal end. The turbine, in turn, spins permanent magnets in an orbit around the outside of a cylindrical containment shell. Such containment shell is made of titanium or aluminum and will allow the spinning magnets fields to enter and induce electrical currents in coils within. Current from the coils is rectified and filtered to provide a DC operating voltage through intrinsically safe connectors to various loads including drillstring steering controls, radars, and telemetry circuits. The hydraulic and pneumatic flows stream past all around the cylindrical containment shell from the turbine on their way to the drillbit motor.

In alternative embodiments, the turbine drives a shaft that enters the nose of the cylindrical containment shell through stuffing boxes and sealed bearings to spin magnets placed inside. In still other embodiments of the present invention, the turbine spins the magnets external to the cylindrical containment shell, and these magnetically clutch to internal magnets that turn a generator.

An advantage of the present invention is that a generator is provided for directional drilling.

Another advantage of the present invention is that a generator is provided that is intrinsically safe.

A further advantage of the present invention is a self-powered drillstring system is provided.

These and other objects and advantages of the present invention will no doubt become obvious to those of ordinary skill in the art after having read the following detailed description of the preferred embodiment which is illustrated in the various drawing figures.

IN THE DRAWINGS

Figure 1B:
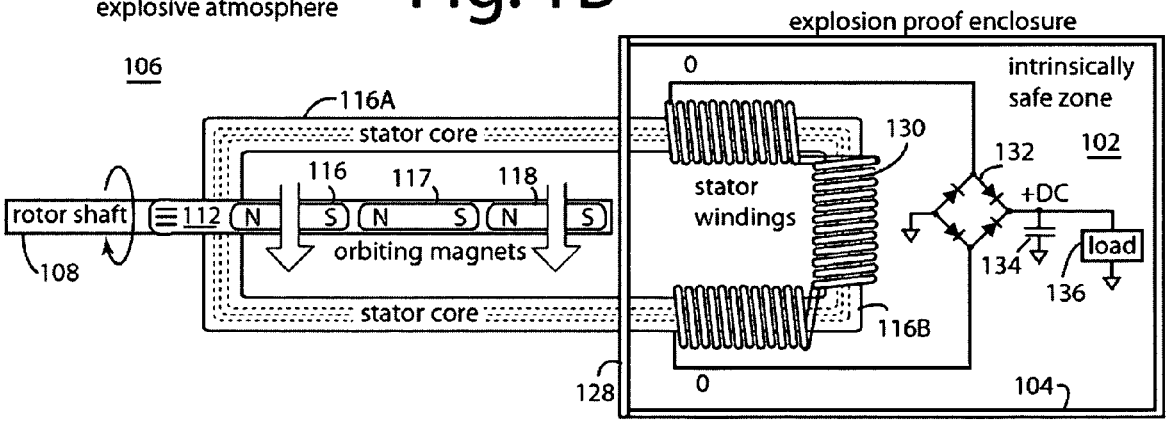
Figure 1C:
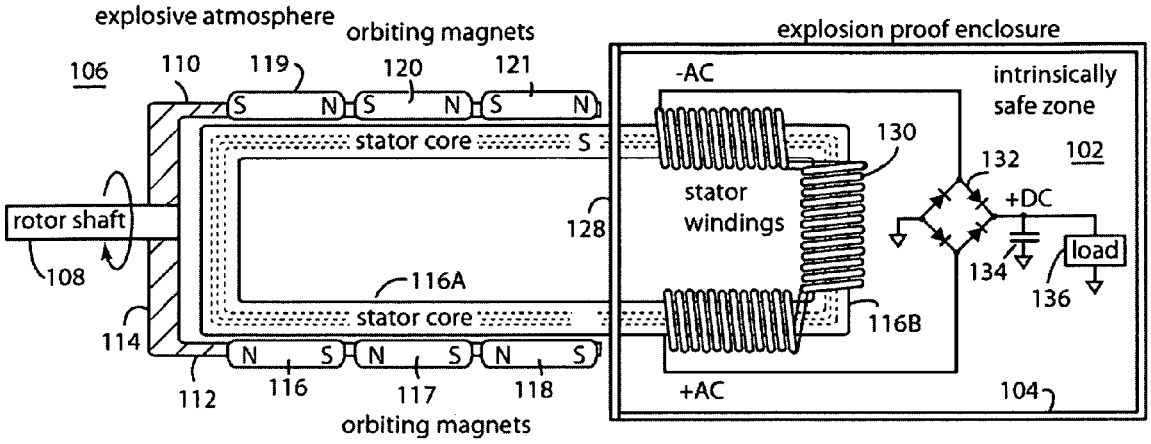
Figure 1D:
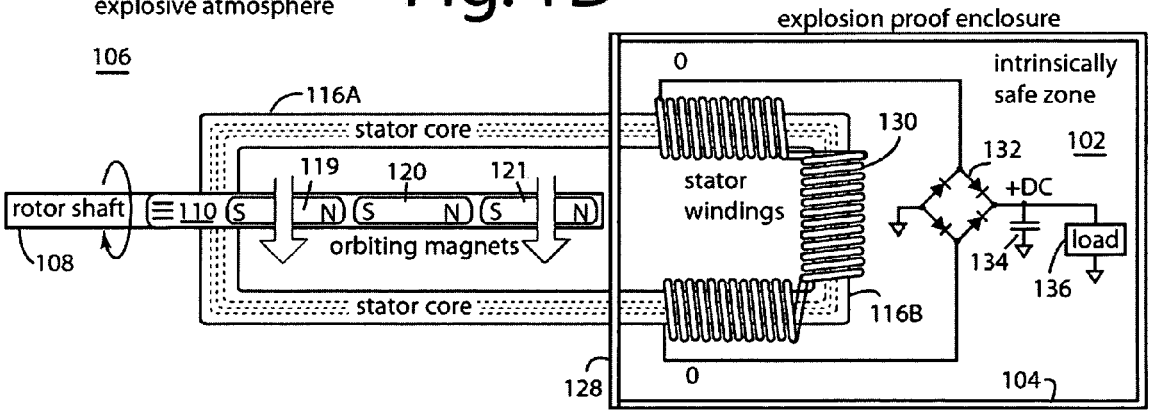
Figure 2:
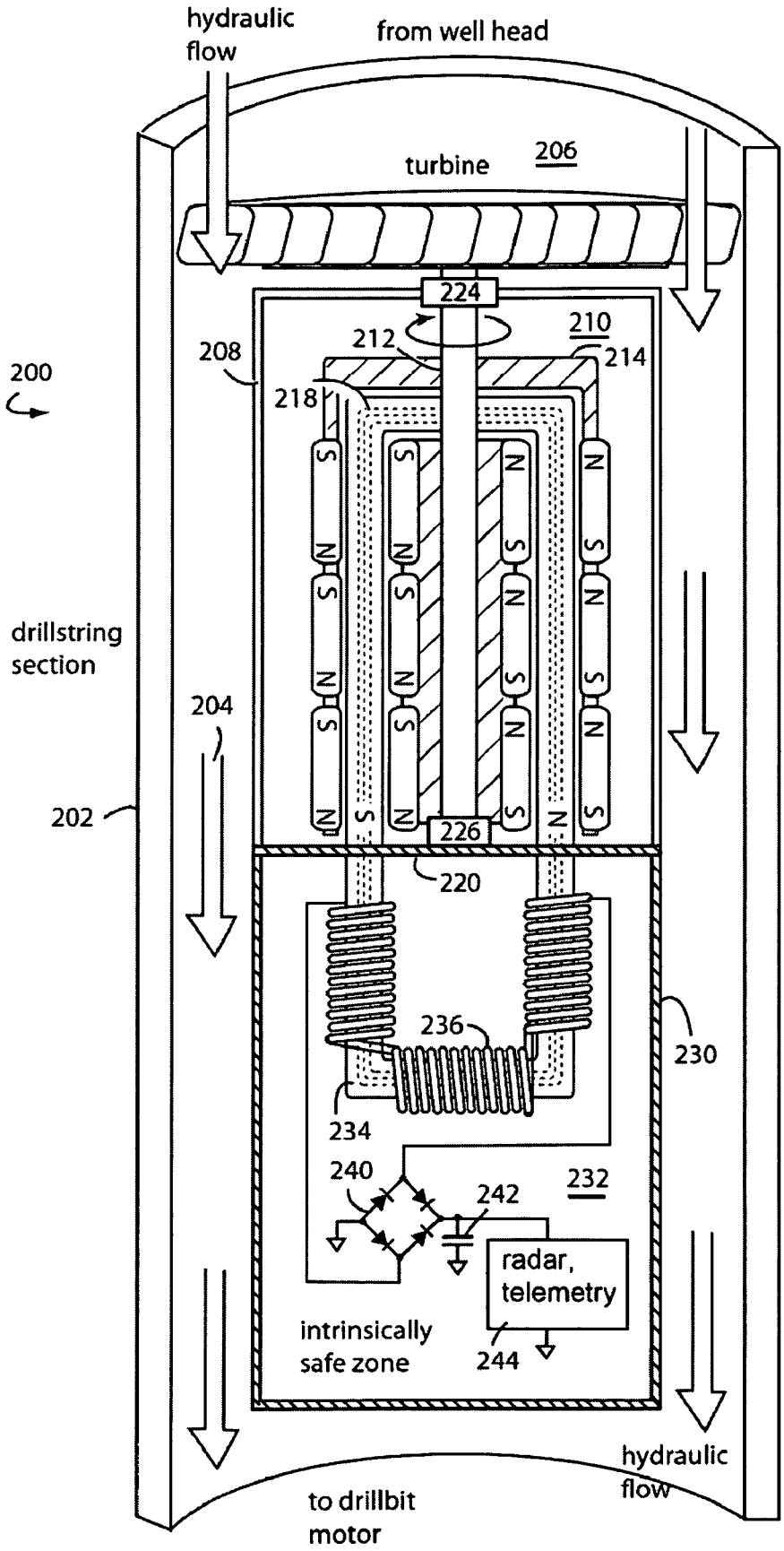

FIGS. 1A-1D are side view diagrams an explosion proof electrical generator embodiment of the present invention, in which four positions of the rotor are shown, FIG. 1A 0°, FIG. 1B 90°, FIG. 1C 180°, and FIG. 1D 270°; and FIG. 2 is a cutaway side view diagram of a generator like that of FIGS. 1A-1D, but with rotor magnets that spin inside and outside of the exposed core part, and that is fitted inside a drillstring section with a turbine to generate electrical power from a flow of pressurized hydraulic fluid flowing past down to a drillbit motor.

DETAILED DESCRIPTION OF THE PREFERRED EMBODIMENTS

FIGS. 1A-1D represent an explosion proof electrical generator embodiment of the present invention, and is referred to herein by the general reference numeral 100. Generator 100 operates with a protected, intrinsically safe compartment 102 inside an explosion proof enclosure 104. All the electrical components that could otherwise ignite an explosive atmosphere 106 are disposed inside and sealed. A source of rotating mechanical power, e.g., a turbine, power-take-off (PTO), gear, or wheel, drives a rotating input shaft 108. Such mechanical power will be converted into electrical power by generator action.

A yoke 110 has two arms 112 and 114 that are spun in a cylinder section surrounding an exposed part 116A of an annular magnetic stator core 116. A protected part 116B is inside the intrinsically safe compartment 102 within explosion proof enclosure 104. The two core pieces 116A and 116B communicate magnetically across a small gap cut by an intervening membrane 118. For example, membrane 118 may comprise titanium, aluminum, or other non-ferromagnetic metal. The remainder of enclosure 104 will typically comprise stainless steel.

The distal ends of yoke arms 112 and 114, with magnets 122 and 125, may induce swirling eddy currents into membrane 118. These would be best controlled by selecting a material for membrane 118 that is a poor conductor of electricity. Titanium would therefore be preferred, as well as stainless steel.

Yoke arms 112 and 114 each carry several permanent bar magnets with their magnetic poles arranged head-to-toe, N-S-N-S. For example, six magnets 120-125 are shown in FIGS. 1A-1D. The length of exposed part 116A of stator core 116, the length of yoke arms 112 and 114, and the number of magnets 120-125, can be increased proportionately with requirements for generator 100 to be able to produce more power.

Stator core 116 will typically comprise thin laminated and insulated sheets iron, or iron alloyed with silicon, to control the spurious eddy currents that would otherwise rob power away.

The spinning of magnets 120-125 in circular orbits around stator core 116 will induce corresponding, but alternating magnetic fields in stator core 116. FIGS. 1A-1D are intended to show the magnetic and electric states that exist in generator 100 at 0°, 90°, 180°, and 270°, of rotation of input shaft 108.

The distal ends of yoke arms 112 and 114, with magnets 122 and 125, may induce swirling eddy currents into membrane 118. These would be best controlled by selecting a material for membrane 118 that is a poor conductor of electricity.

The magnetic fields induced into the exposed part 116A of stator core 116 easily jump the gap in the core caused by membrane 118 into the protected part 116B of stator core 116. Here, a series of copper wire windings 130 will have an alternating current (AC) induced into them. Such AC current is rectified by a full-wave bridge 132, and the resulting direct current (DC) is filtered by a capacitor 134 and connected to a load 136.

For example, load 136 represents any kind of electrically powered instrument that needs to be operated safely in an explosive atmosphere 106.

In alternative embodiments of the present invention, magnets 120-125 can be spun inside the exposed part 116A of stator core 116, or both inside and outside for increased magnetic induction. The placement of bearings, struts, and other supports is conventional and need not be explained further herein.

C-shaped cores are illustrated in FIGS. 1A-1D for stator core 116, but any kind of core may be used, e.g., U-shaped, E-shaped, toroidal, planar, EFD-cores, ER-cores, and even EP-cores. The critical aspect is an intervening gap for an explosion proof containment membrane cuts through some part of the core to keep electric circuits inside and the rotating magnets outside.

Generator 100 has been described as a device to convert mechanical power in an explosive atmosphere into electrical power inside an intrinsically safe enclosure. However, as is true with conventional motor-generators, generator 100 may be operated as a motor. E.g., to convert electrical power inside the intrinsically safe enclosure into mechanical power in the explosive atmosphere. To do this, more magnetic poles would be required and an inverter to convert DC power to AC power at the windings.

FIG. 2 represents a generator, like that of FIGS. 1A-1D, but with rotor magnets that spin inside and outside of an exposed core part. Such is fitted inside a drillstring section with a turbine to generate electrical power from a flow of pressurized hydraulic fluid flowing past down to a drillbit motor.

Specifically, a drillstring section embodiment of the present invention, referred to herein by the general reference numeral 200, comprises a pipe section 202 that can screw into a directional drillstring above a conventional drillstring motor. A turbine 204 is turned by a fluid flow 206. A nose shroud 208 keeps fluid out of a rotor area 210. A rotor shaft 212 carries an outer magnetic impeller 214 and an inner magnetic impeller 216. These orbit around an upper U-shaped magnetic core 218 that butts down onto a titanium separator plate 220. The rotor shaft 212 is supported by thrust bearings 224 and 226.

The titanium separator plate 220 and an explosion proof housing 230 form a complete gas-tight intrinsically safe confinement area 232 for electrical components. A lower U-shaped magnetic core 234 butts up against titanium separator plate 220 with its ends aligned to corresponding ends of the upper U-shaped magnetic core 218. For example, to maximize magnetic coupling between the magnetic core pieces. The alignment is such that a complete magnetic circuit is formed between the core pieces 218 and 234.

A series winding 236 will produce alternating electrical current induced from core 234 by alternating magnetic fields coupled into the core 218 from the spinning of magnetic impellers 214 and 216. A full-wave bridge 240 and filter 242 convert this to direct current for radar, directional steering, telemetry, or other instrumentation 244. For example, such instrumentation will be as designed, specified, and patented by Stolar, Inc. (Raton, N. Mex).

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A generator for use in explosive atmospheres, comprising:

an intrinsically safe enclosure providing for the safe operation of electrical instrumentation in an explosive atmosphere;

a magnetic core having an exposed part external to the intrinsically safe enclosure and a protected part internal to the intrinsically safe enclosure, and arranged such that magnetic fields will couple between them over a separation gap necessitated by a portion of the intrinsically safe enclosure;

an input rotor for being driven by a source of mechanical energy external to the intrinsically safe enclosure;

a number of permanent magnets mounted to be spun in orbits around said exposed part of the magnetic core by the input rotor; and a winding disposed around said protected part of the magnetic core, and for producing electrical power induced from magnetic fields created by the number of permanent magnets when spinning.

2. The generator of claim 1, further comprising:

a titanium membrane forming a part of the intrinsically safe enclosure that comes between the exposed and protected parts of the magnetic core.

3. The generator of claim 1, further comprising:

an increased number of permanent magnets mounted to be spun in orbits around said exposed part of the magnetic core by the input rotor; and an increased size of said exposed part of the magnetic core;

wherein, an increased electrical power is thereby made available from the winding inside the intrinsically safe enclosure.

4. The generator of claim 1, further comprising:

a section of pipe for connection to a drillstring and for carrying all other components inside of it;

a turbine providing for rotational drive of input rotor when a hydraulic flow passes through inside the section of pipe.

5. The generator of claim 1, further comprising:

an electrical power connection providing for the operation of drillstring instrumentation.

6. A method for generating electrical power in an explosive atmosphere, comprising:

placing all components that operate with a flow of electrical current inside an explosion proof enclosure;

splitting a magnetic core into two pieces and mounting one outside said explosion proof enclosure and the other inside such that any gap between them is minimized to the thickness of an intervening sheet part of said explosion proof enclosure;

inducing magnetic fields with rotating magnets driven by mechanical input power into said part of said magnetic core that is outside;

inducing electrical current into a winding disposed around said part of said magnetic core that is inside said explosion proof enclosure; and using said electrical current to power any instrumentation also disposed inside said explosion proof enclosure.

7. The method of claim 6, wherein:

the splitting is such that said intervening sheet part of said explosion proof enclosure comprises titanium.

8. The method of claim 6, further comprising:

increasing the magnetic field strength induced by said rotating magnets into said part of said magnetic core that is outside;

wherein, more electrical power is made available from said winding.

9. A drillstring device, comprising:

a section of pipe for connection to a drillstring;

an intrinsically safe enclosure providing for the safe operation of electrical instrumentation in an explosive atmosphere, and disposed inside the section of pipe;

a magnetic core having an exposed part external to the intrinsically safe enclosure and a protected part internal to the intrinsically safe enclosure, and arranged such that magnetic fields will couple between them over a separation gap necessitated by a portion of the intrinsically safe enclosure;

a turbine providing for rotational drive of an input rotor when a hydraulic flow passes through inside the section of pipe and external to the intrinsically safe enclosure;

a number of permanent magnets mounted to be spun in orbits around said exposed part of the magnetic core by said input rotor;

a winding disposed around said protected part of the magnetic core and inside the intrinsically safe enclosure, and for producing electrical power induced from magnetic fields created by the number of permanent magnets when spinning; and a drillstring instrument for operation by said electrical power taken from the winding.

* * * * *